US006082841A

United States Patent [19]

Smith et al.

[11] Patent Number: 6,082,841

[45] Date of Patent: Jul. 4, 2000

[54] CONTAINER SYSTEM SUPPORTED BY ONE OR MORE APPLIANCES

[76] Inventors: Paul C. Smith; Thomas L. Nixon, both of P.O. Box 1200, Occidental, Calif. 95465

[21] Appl. No.: 09/072,630

[22] Filed: May 5, 1998

[51] Int. Cl.[7] ..... A47F 9/00

[52] U.S. Cl. ..... 312/245; 312/330.1; 312/228.1; 248/200

[58] Field of Search ..... 312/245, 140.4, 312/228, 228.1, 330.1; 108/64, 65, 90, 42, 47, 152; 220/334; 68/235, 237; 248/200, 225.11, 300

[56] References Cited

U.S. PATENT DOCUMENTS

| | | | |
|---|---|---|---|
| D. 371,014 | 6/1996 | Smith . | |
| 2,201,826 | 5/1940 | Ditchfield | 248/200 |
| 2,445,915 | 7/1948 | Karry . | |
| 2,848,761 | 8/1958 | Hahn | 248/200 X |
| 3,526,314 | 9/1970 | Trammell, Jr. | 224/275 |
| 3,712,696 | 1/1973 | McDonnell | 312/245 |
| 4,425,012 | 1/1984 | Kley | 312/245 X |
| 4,466,148 | 8/1984 | Jones | 248/200 X |
| 4,713,949 | 12/1987 | Wilcox . | |
| 5,392,934 | 2/1995 | Fox | 312/245 X |
| 5,411,164 | 5/1995 | Smith . | |
| 5,477,969 | 12/1995 | Beeskau et al. | 248/225.11 X |
| 5,518,309 | 5/1996 | St-Pierre | 312/140.4 |

FOREIGN PATENT DOCUMENTS

| | | | |
|---|---|---|---|
| 404090712 | 3/1992 | Japan | 312/228 |

*Primary Examiner*—Peter M. Cuomo
*Assistant Examiner*—Hanh V. Tran

[57] ABSTRACT

A container system is supported by one or more laundry appliances. The container may have an open top with a cover provided, or slide out of a container housing. The container system further includes mounting structure between the container or container housing and the appliance or appliances to support the container or container housing in side by side relationship with one appliance or between two appliances, so that the cover closing the container or the top of the container housing is substantially flush with the top work surface of the adjacent appliance or appliances, effectively forming a continuous work surface.

19 Claims, 6 Drawing Sheets

CONTAINER SYSTEM SUPPORTED BY ONE OR MORE APPLIANCES

BACKGROUND OF THE INVENTION

1. Field of the Invention

Our invention relates to storage systems, and more particularly addresses storage for products used in a residential laundry area. Specifically, the present invention provides storage for most laundry products in a container system configured to be supported by an appliance or appliances.

2. Discussion of the Prior Art

A variety of products are used in home laundry areas. Specialized storage apparatus for these products is limited in the prior art. U.S. Pat. Nos. 5,411,164 and D371,014,Paul and Barbara Smith, commonly assigned, address this need in a unit deriving lateral stability from two adjacent appliances while the weight is supported on the floor by legs or the walls of a pedestal. While this concept works well, the supporting structure, packaging, and retail shelf space requirements add to the cost and affect merchandising of the unit. Therefore, there is a need to provide a suitable alternative that can be manufactured and sold at lower cost.

SUMMARY OF THE INVENTION

A container system for laundry products, trash, and the like is supported by one or more laundry appliances. A container comprising the container system may be approximately equal in length to the front to back depth of an appliance, and about 6" to 9" in width and 12" to 15" in height. The container may be open topped with a cover provided, or slide in and out of a container housing. Rollers may be provided for easier operation of a slidable container. The container system further comprises mounting means communicating between the container or container housing and the appliance or appliances to support the container or container housing in side by side relationship with one appliance or between two appliances, whereby the cover closing the container or the top of the container housing is substantially flush with the top work surfaces of the adjacent appliances or appliances, effectively forming a continuous work surface. While simple mechanical fasteners such as sheet metal screws metal screws may be employed, a less invasive mounting system may be provided that requires little or no use or tools.

Mounting means preferably comprises one or more container supporting brackets placed between the top panel and body of an appliance cabinet, an outwardly projecting flange near the top of one or both side of the container or container housing communicating with the adjacent appliance or appliances, Velcro and adhesive fasteners, or other suitable alternatives. Construction of the container system is preferably of molded plastic for economy, durability, and resistance to laundry agents. The container may be assembled from multiple panels and so be efficiently packaged in flat cartons of minimal size. Alternatively, containers may be injection molded to nest within one another for efficient shipping and merchandising.

Objectives

Our invention provides a system for storing laundry products in the location where needed, i.e. adjacent to the appliances in which they are used. An important objective of the invention is to provide the utility described with a minimal and efficient structure thereby lowering the manufacturing, packaging, shipping, and merchandising costs and thus the cost to the consumer. Preferably the system requires minimal packaging and shelf space in the retail environment. Further objectives include ease of installation and reliability.

DETAILED DESCRIPTION OF THE PREFERRED EMBODIMENTS

Figure 1:
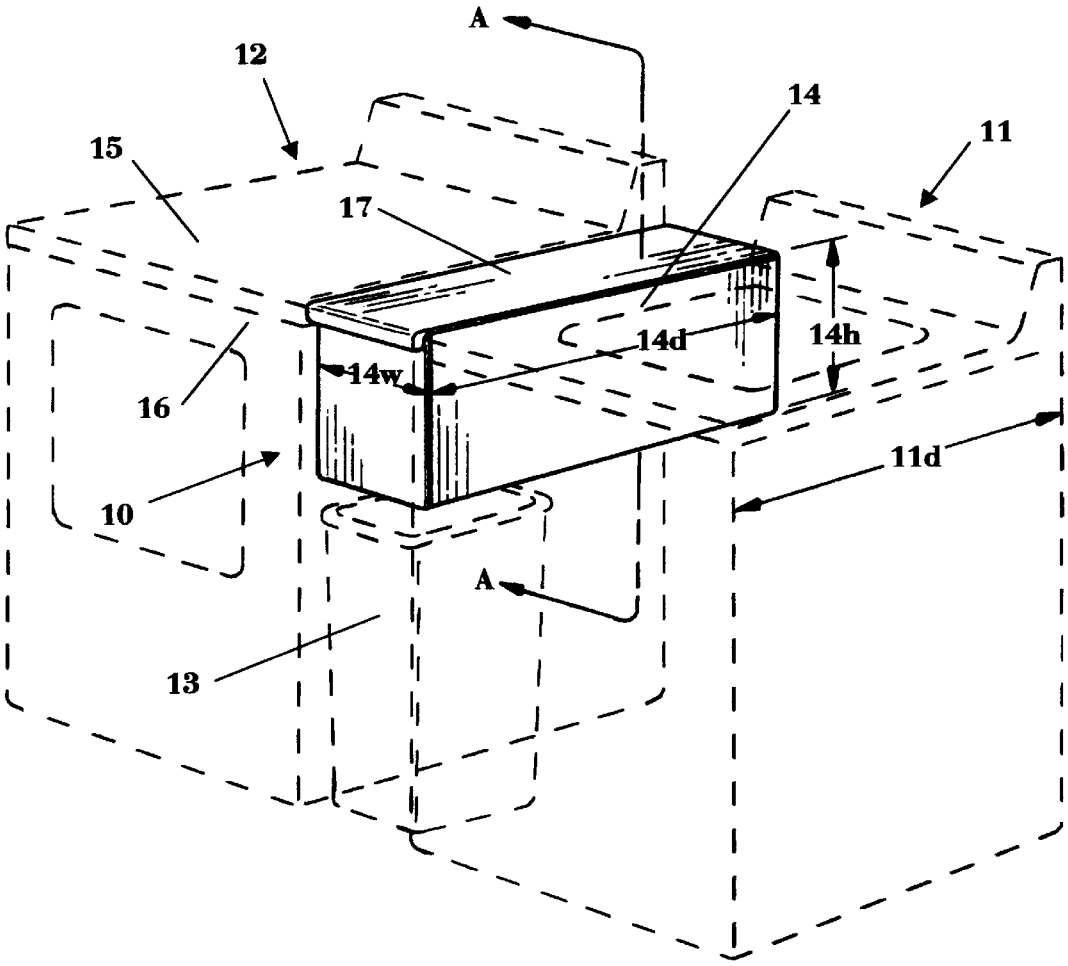
FIG. 1 is a perspective view of a container storage system in accordance with one embodiment of the current invention, shown in one intended environment.

In FIG. 1, an embodiment of our storage system 10 is showing in one intended environment. A clothes washer 11 and dryer 12, as well as a wastebasket 13 under the container system are shown for illustration purposes only and are not in themselves part of the invention. A container 14 is supported by mounting means placed between the top panel 15 and the body 16 of the dryer housing, as will be described shortly. The open top of the container 14 is closed by a cover 17, effectively providing a continuous work surface with the two appliances 11, 12. The horizontal depth 14*d* of the container 14 is compatible with the depth 11*d* of the appliances. Preferably, the height 14*h* or the container 14 is approximately 12" to 14" and the width 14*w* of is approximately 6" to 9" to accommodate many common laundry products in their packing or to allow powdered products to be poured into the container. Space is available under the storage system 10 for the wastebasket 13, a roll out unit with additional storage, hamper, or the like.

Figure 2:
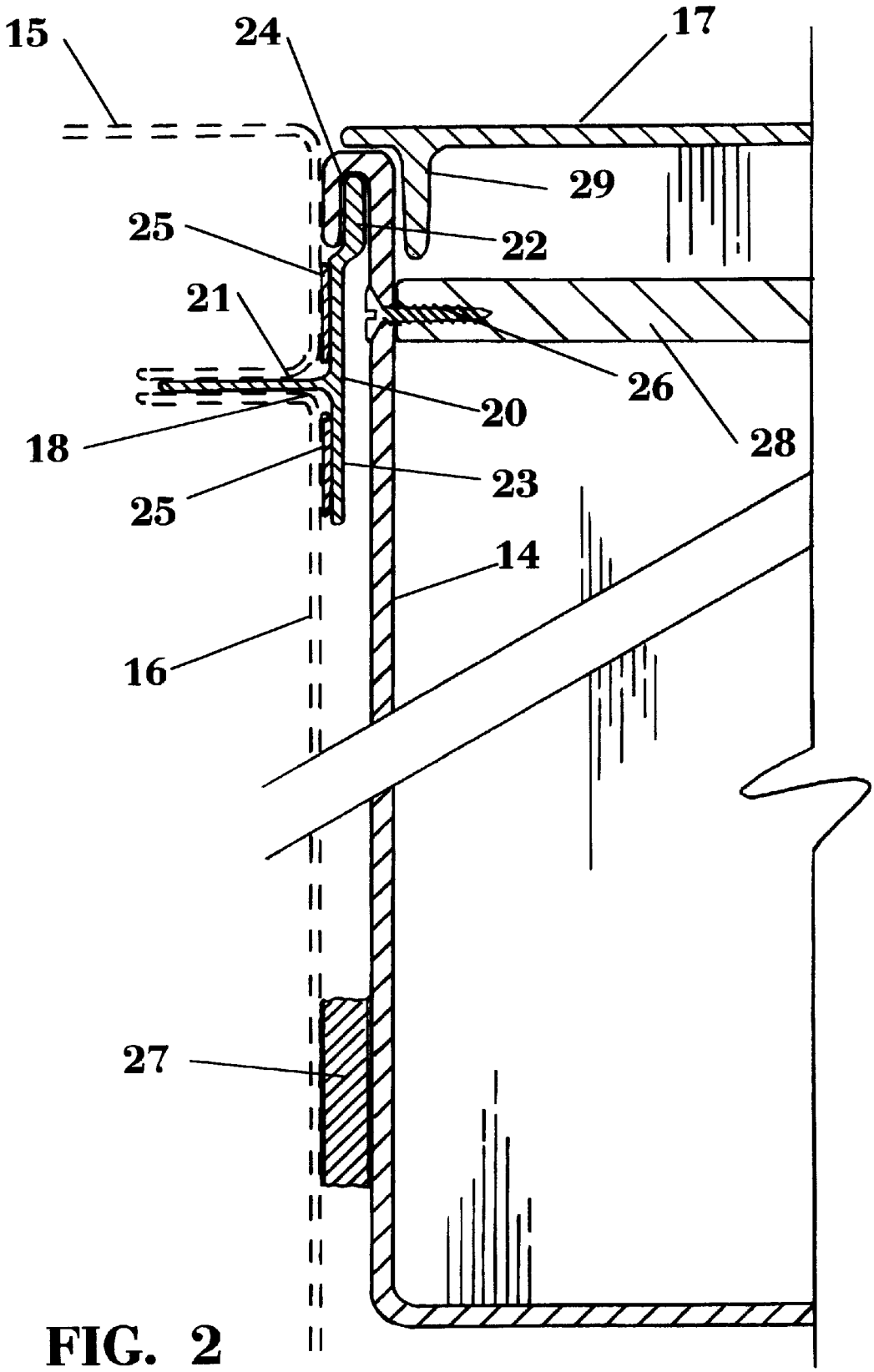
FIG. 2 is a partial front-cross sectional detail view of the container system shown in FIG. 1.

FIG. 2 is a front cross-sectional detail view at Sec. A—A of FIG. 1 detailing mounting means for mounting the container on one or both appliances 11, 12. Typically, the top panel 15 of a home laundry appliance is held in position on the body 16 of the appliance housing by anchors at the back of the panel and spring clips across the front of the panel. Thus, there is an intersection 18 along the sides of the appliance between the top panel 15 and body 16 that can be opened slightly against the resistance of the spring clips. In the embodiment shown in FIG. 2, a first leg 21 of a "T" shaped mounting bracket 20 is inserted between the top panel 15 and body 16. A second leg 22 extends vertically to engage a channel 24 along sidewall at the top of the container 14. A third leg 23 extends downwardly. The "T" shape provides a surface for tapping on the bracket 20 to insert it at the intersection 18 without needing to open the appliance top. Spacer means 25 having adhesive coatings can be used to adhere the bracket 20 to the side of the appliance body and maintain the clearance required for the second leg 22 to engage the container 14. Additional adhesive spacer means 27 can be used near the bottom of the container 14 as required. The spacer means 25, 27 also reduce the potential for noise from vibration. Aluminum extrusions, being strong, rigid, and rustproof, are preferred for fabricating the brackets 20. Spreader means 28 fixing the width between the sidewalls of the container 14 is also shown in FIG. 2, fastened by a screw 26. The cover 17 preferably having stiffening and alignment ribs 29 is shown in place on the container 14.

Figure 3:
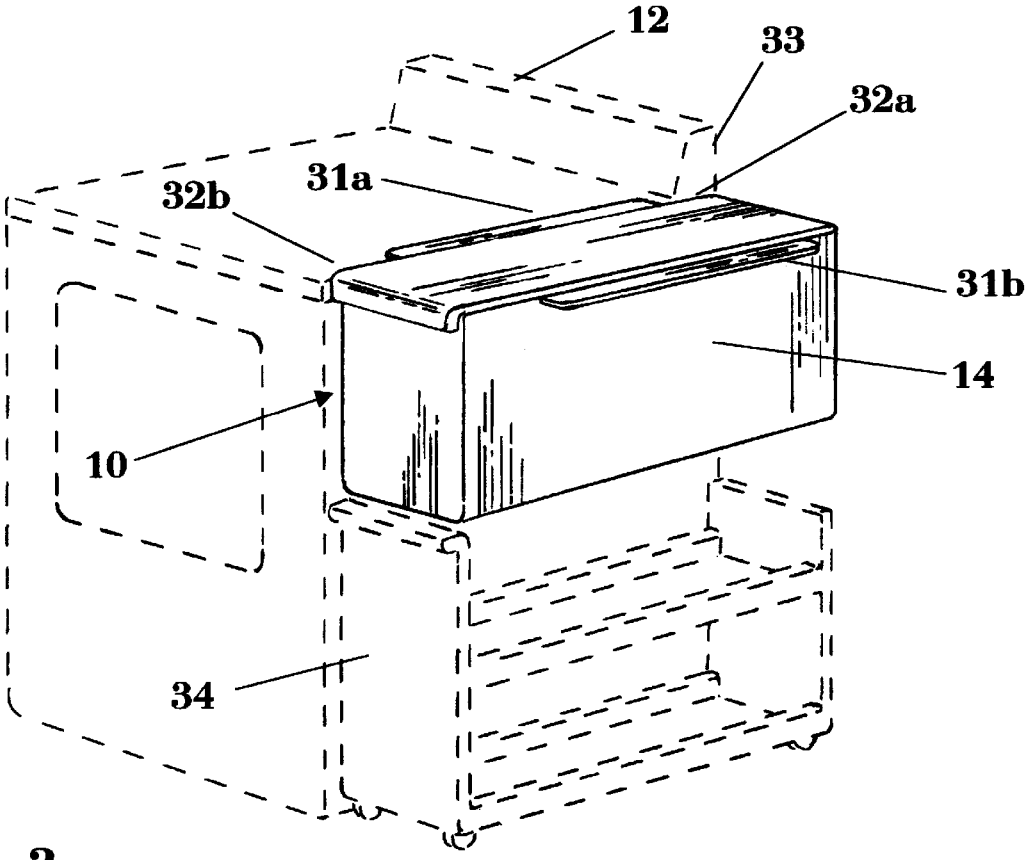
FIG. 3 is a partial perspective view of a second embodiment of the container system wherein a flange overlapping an appliance comprises the mounting means.

FIG. 3 shows a second embodiment in perspective wherein the container 14 is supported by a flange 31*a* extending outwardly from the sidewall of the container to overlap the top of the adjacent appliance 12 to provide support. The flange 31*a* does not extend the full length of the container 14, leaving an end 32*a* of the container without a flange so as to accommodate the control head 33 of the typical appliance. If this allowance is made at both ends 32*a*, 32*b*, the container system 10 may be reversible and thus useable on either side of an appliance. As an option, a second flange 31*b* is shown on the other sidewall of the container 14 to overlap a second adjacent appliance. A rollout storage unit 34 shows another possibility for good use of the space below the container system 10.

Figure 4:
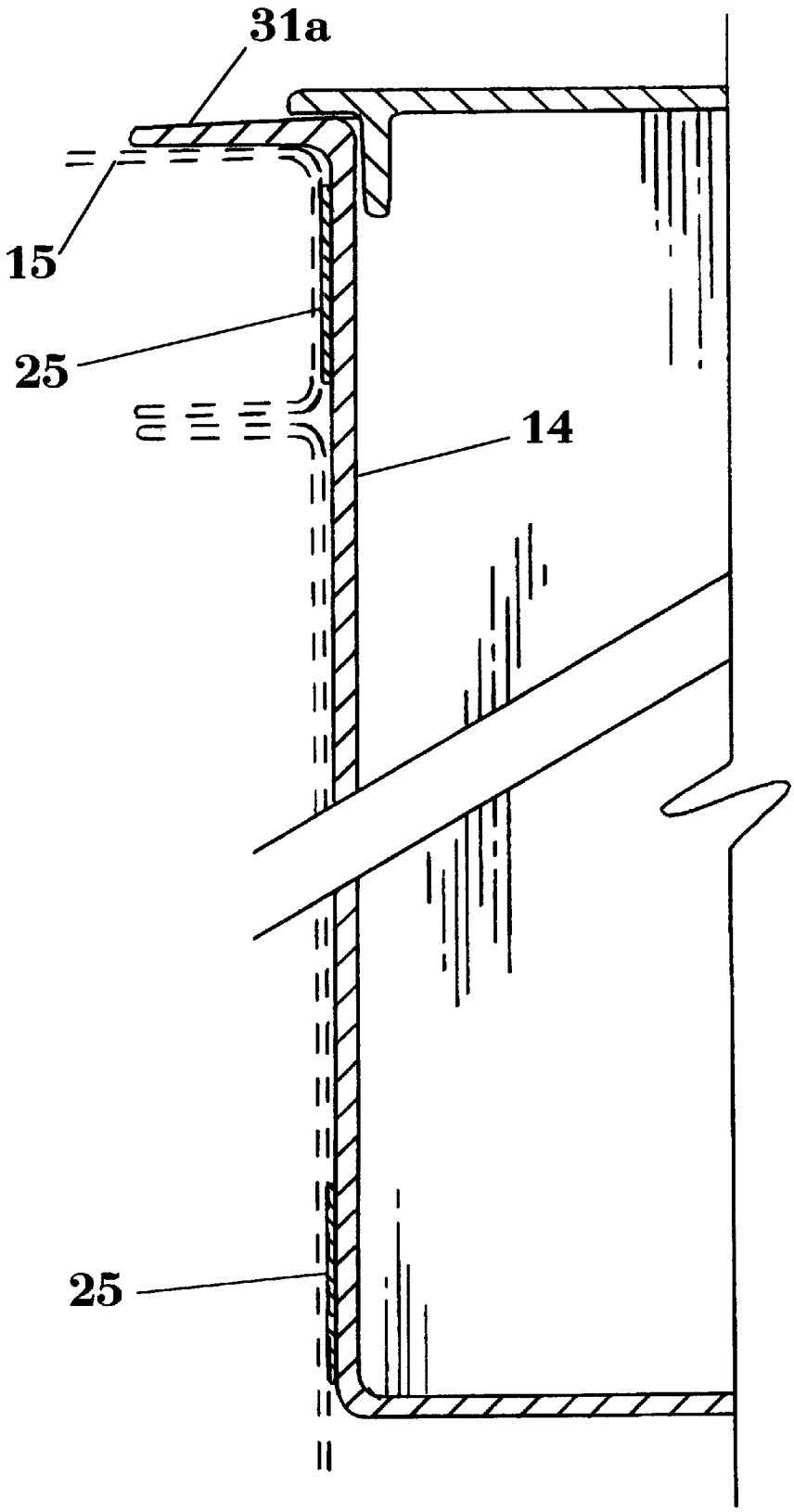
FIG. 4 is a partial front cross-sectional detail view of the container system of FIG. 3 showing the overlapping flange.

FIG. 4 is a front cross-sectional detail view of the container system 10 of FIG. 3 showing the flange 31*a* overlapping and engaging the top 15 of the appliance 12. Preferably, the flange 31*a* tapers as it extends outwardly to concentrate strength where needed. Adhesive spacer means 25 is employed between the sidewall of the container 14 and the appliance 12 to prevent outward movement of the container that would disengage the flange, and also eliminates vibration noise.

Figure 5:
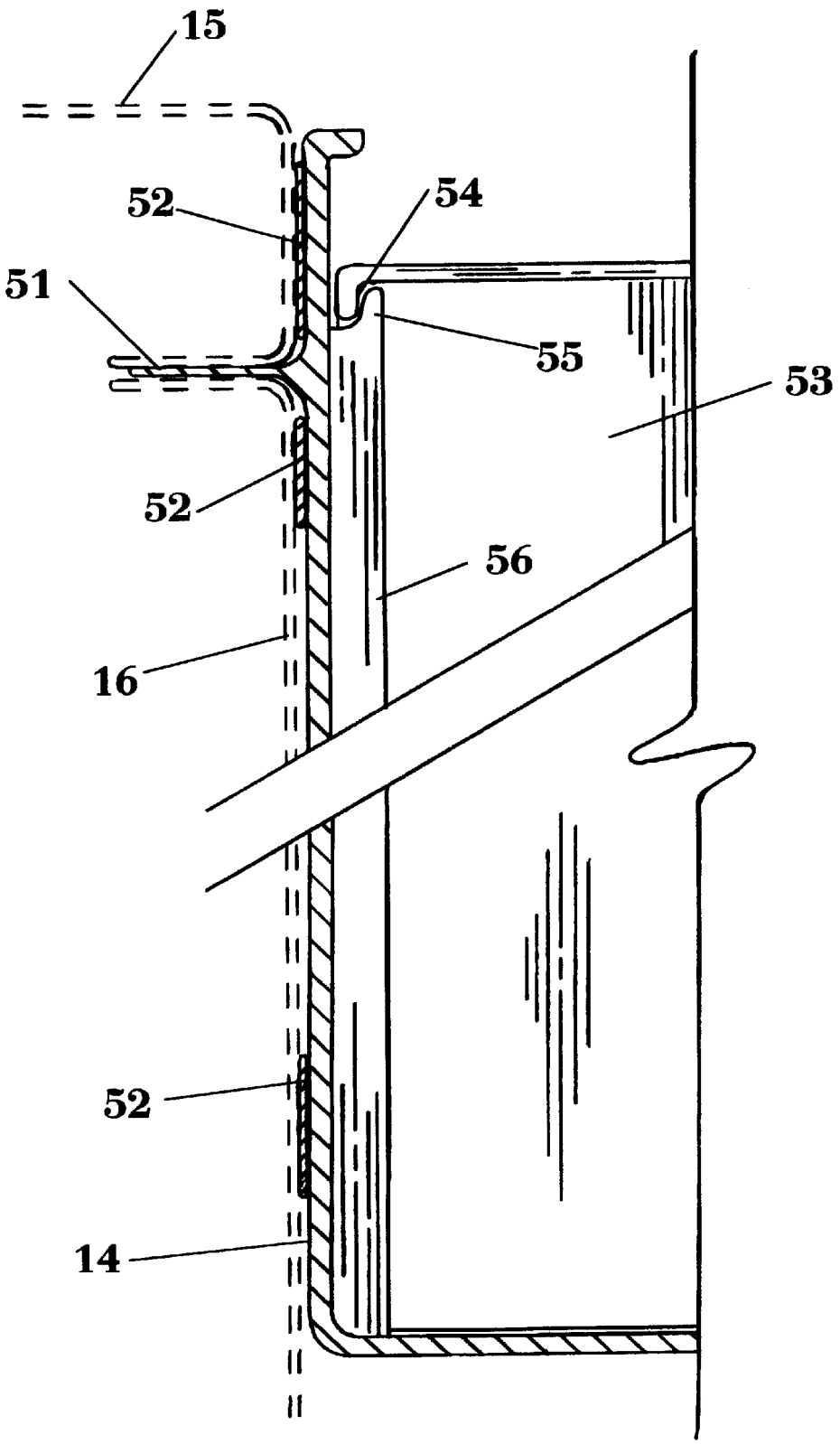
FIG. 5 is a front cross-sectional detail view of a modified container system with bracket between the top panel and the body of an appliance housing.

FIG. 5 shows a front cross-sectional view of modified version of the embodiment of the container system shown in FIGS. 1 and 2. A thin flange 51, molded or otherwise attached to the side of the container 14, is positioned at the intersection of the top 15 and body 16 to resist downward movement. Adhesive spacer means 52 is used to resist outward movement of the container and reduce noise from vibration. A removable divider panel 53 for dividing the interior of the container 14 into multiple compartments is shown. Ears 54 on the divider panel engage notches 55 at the top of opposing pairs of dividers ribs 56 on the sidewalls of the container 14, thereby serving the function of spreader means 28 in shown FIG. 2.

Figure 6:
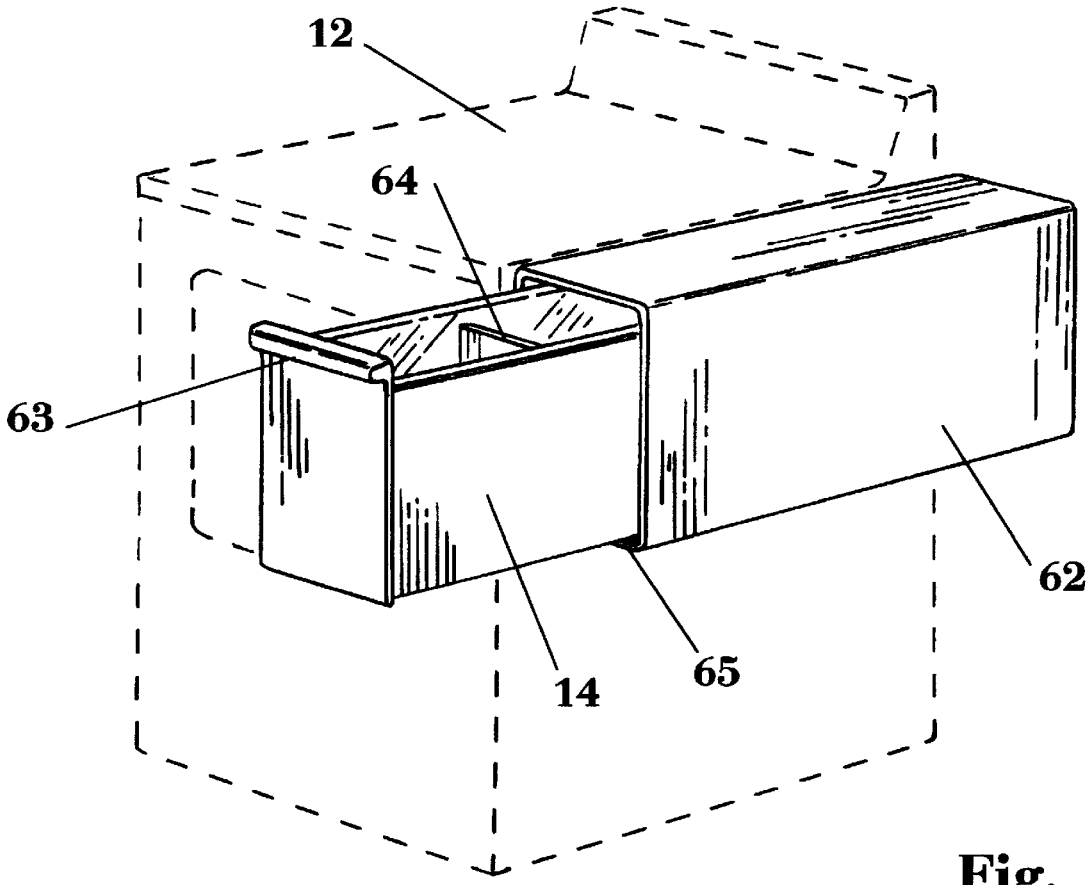
FIG. 6 is a perspective view of another embodiment of the container system in accordance with the present invention wherein the container slides in and out of a container housing.

FIG. 6 is a perspective view of a container system 10 in accordance with the present invention wherein the container 14 slides in and out of a container housing 62. Preferably, rollers 65 are disposed between the container housing 62 and container 14 to ease operation. A handle 63 is preferably provided. A divider 64, which may be either fixed or movable, is shown in the interior of the container 14. The mounting means of such a container system of the appliance 12 may be one of those previously discussed, with some additional consideration for the shift in weight distribution that occurs when the container 14 is in the outward position shown in FIG. 6. This roll out arrangement is especially useful with front-loading appliances that may have a continuous countertop or the like above them precluding the use of a top opening unit.

Thus, various embodiments of our container system supported by one or more appliances have been shown and described. Although certain examples and advantages have been described, other modifications, mounting means, and additional advantages may become apparent to those skilled in the art from the disclosures herein. For example, other mounting means such as Velcro and adhesive fasteners may be used. Also, the container system may be used in other environments, such as kitchen or garage, attached to one or more appliances including cabinetry. Therefore, the invention is not to be limited except in the spirit of the claims that follow.

We claim:

1. A container system for use with one or more appliances, comprising:

a container having an open top, first and second sidewalls, and a bottom;

a cover for the container, that can be manipulated between a closed position and an open position that allows access to the interior of the container;

mounting means being provided on at least one of said first and second sidewalls for securing the container to and in side by side relationship with at least one appliances and;

wherein the cover of the container, when in the closed position, is adapted to be approximately at the same level as a top work surface of the adjacent appliance whereby the cover provides an effective extension of the work surface of the appliance.

2. The system of claim 1 wherein the length of the container is approximately equal to the front to back depth of the appliance.

3. The system of claim 2 wherein the width of the container is approximately 6" to 9" and the height of the container is approximately 12" to 15".

4. The system of claim 1 wherein the mounting means comprises at least one container supporting bracket adapted to be placed between a top panel and a sidewall structure of the appliance housing to resist downward movement of the container.

5. The system of claim 4 wherein the bracket has a first substantially horizontal leg for placement between the top panel and body of the appliance housing and a second upwardly projecting leg for engaging the container.

6. The system of claim 5 wherein the bracket has a third downwardly projecting leg to facilitate installation and provide additional stability.

7. The system of claim 4 wherein adhesive spacer means is adapted to be disposed between at least one vertical surface of the bracket and the appliance housing to resist outward and downward movement of the bracket and reduce noise from vibration.

8. The system of claim 1 wherein the mounting means comprises a first flange projecting outwardly from a first sidewall of the container whereby the flange is adapted to engage the top of a first appliance to resist downward movement of the container.

9. The system of claim 8 wherein a second flange projects outwardly from a second sidewall of the container whereby the second flange is adapted to engage the top of a second appliance.

10. A container system for use with one or more appliances comprising:

a container housing having first and second sidewalls top and bottom walls and an open front;

an open topped container configured to slide in and out of the open front of the container housing;

mounting means being provided on at least one of said first and second sidewalls for securing the container housing to and in adjacent side by side relationship with at least one appliance, and, wherein the top of the container housing is adapted to be approximately at the same level as a top work surface of the at least one appliance.

11. The system of claim 10 wherein the length of the container housing is approximately equal to the front to back depth of the appliance.

12. The system of claim 10 wherein the width of the container housing is approximately 6" to 9" and the height of the container is approximately 12" to 15".

13. The system of claim 10 wherein the mounting means comprises at least one container supporting bracket adapted to be placed between a top panel and a sidewall structure of the appliance housing to resist movement of the container housing.

14. The system of claim 13 wherein the bracket has a first substantially horizontal leg for placement between the top panel and sidewall structure of the appliance housing.

15. The system of claim 13 wherein adhesive spacer means is disposed between at least one vertical surface of the bracket and the body of the appliance housing to resist outward and downward movement of the bracket and reduce noise from vibration.

16. The system of claim 10 wherein the mounting means comprises a first flange projecting outwardly from the first sidewall of the container housing whereby the flange is adapted to engage a first appliance to resist movement of the container housing.

17. The system of claim 16 wherein a second flange projects outwardly from the second sidewall of the container housing whereby the second flange is adapted to engage a second adjacent appliance.

18. The system of claim 10 wherein the mounting means comprises adhesive means adapted to be disposed between the container housing and an adjacent appliance to resist movement of the container housing.

19. The system of claim 10 wherein rollers are disposed to act between the container housing and the container to reduce friction when the container is moved in and out of the container housing. side by side relationship with at least one appliance securing the container to and in side by side relationship with at least one of the appliances.

* * * * *